US009664153B2

(12) United States Patent
Beyer et al.

(10) Patent No.: US 9,664,153 B2
(45) Date of Patent: May 30, 2017

(54) ENGINE WITH EXHAUST GAS RECIRCULATION

(71) Applicant: Ford Global Technologies, LLC, Dearborn, MI (US)

(72) Inventors: Theodore Beyer, Canton, MI (US); Charles Joseph Patanis, South Lyon, MI (US); William Spence, Warren, MI (US); Jody Michael Slike, Farmington Hills, MI (US); John Christopher Riegger, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 175 days.

(21) Appl. No.: 14/657,610

(22) Filed: Mar. 13, 2015

(65) Prior Publication Data

US 2016/0265487 A1 Sep. 15, 2016

(51) Int. Cl.

| | |
|---|---|
| ***F02M 25/07*** | (2006.01) |
| ***F02M 35/10*** | (2006.01) |
| ***F02M 35/104*** | (2006.01) |
| ***F02M 26/32*** | (2016.01) |
| ***F02M 26/41*** | (2016.01) |

(52) U.S. Cl.

CPC ..... *F02M 35/10222* (2013.01); *F02M 26/32* (2016.02); *F02M 26/41* (2016.02); *F02M 35/104* (2013.01)

(58) Field of Classification Search

CPC ..... F02M 26/41; F02M 26/32; F02M 26/13; F02M 26/22; F02M 26/14; F02F 1/4264

USPC ..... 123/41.82 R, 568.12, 568.13

See application file for complete search history.

(56) References Cited

U.S. PATENT DOCUMENTS

| | | | | |
|---|---|---|---|---|
| 4,328,781 A * | 5/1982 | Morita | F02M 26/41 | 123/184.39 |
| 4,643,157 A * | 2/1987 | Nishikawa | F02F 1/38 | 123/568.13 |
| 5,490,488 A * | 2/1996 | Aversa | F02B 75/22 | 123/184.31 |
| 6,478,017 B2 | 11/2002 | Bianchi | | |
| 6,971,378 B2 * | 12/2005 | Mackey | F02B 75/22 | 123/568.12 |
| 7,069,918 B2 * | 7/2006 | Mackey | F02B 75/22 | 123/568.12 |
| 7,625,257 B1 * | 12/2009 | Broman | B63H 20/26 | 440/89 B |

(Continued)

FOREIGN PATENT DOCUMENTS

| | | | | |
|---|---|---|---|---|
| JP | 2008-45499 | * | 2/2008 | F02M 25/07 |
| JP | 2009-215972 | * | 9/2009 | F02M 25/07 |

(Continued)

*Primary Examiner* — Hai Huynh

(74) *Attorney, Agent, or Firm* — Brooks Kushman P.C.; Greg P. Brown

(57) ABSTRACT

A cylinder head for an engine defines first and second exhaust runners fluidly coupled to an exhaust passage extending transversely in the head to an exhaust port on an exhaust side. The head defines an exhaust gas recirculation (EGR) passage connected to the exhaust passage and extending longitudinally to an EGR port on the exhaust side. The head also defines a cooling jacket passage adjacent to and substantially surrounding the EGR passage to cool EGR gases prior to cooling by an EGR cooler.

20 Claims, 4 Drawing Sheets

(56) References Cited

U.S. PATENT DOCUMENTS

| | | | | |
|---|---|---|---|---|
| 2012/0085300 | A1 | 4/2012 | Asano et al. | |
| 2013/0055970 | A1 | 3/2013 | Harada et al. | |
| 2016/0025045 | A1 * | 1/2016 | Engineer | F02M 25/07<br>123/568.12 |

FOREIGN PATENT DOCUMENTS

| | | | | |
|---|---|---|---|---|
| JP | 4537615 B2 | | 9/2010 | |
| JP | 2011-236849 | * | 11/2011 | F02M 25/07 |
| JP | 2014-109205 | * | 6/2014 | F02M 25/07 |

* cited by examiner

ENGINE WITH EXHAUST GAS RECIRCULATION

TECHNICAL FIELD

Various embodiments relate to exhaust gas recirculation in an internal combustion engine.

BACKGROUND

As an engine operates, combustion within the cylinder results in exhaust gases. These exhaust gases are typically directed from the cylinder and the engine to an exhaust system that includes emissions reduction or treatment, noise suppression, etc. The exhaust system then vents the exhaust gases to the environment. In some engines, a portion of the exhaust gases may be diverted from the exhaust system and rerouted to the intake manifold in a process known as exhaust gas recirculation (EGR). The EGR gases are mixed with intake air in the intake manifold and are provided to the cylinder in an intake process. By mixing EGR gases with the intake air, the engine may be provided with a reduced fuel consumption and increased fuel economy and efficiency. Before the EGR gases flow into the intake manifold and into the cylinder, the temperature of the EGR gases may need to be reduced. By reducing the temperature of the EGR gases and intake mixture, the chance of pre-ignition in the cylinder is reduced. Pre-ignition occurs, for example, when the combustion process begins before the spark in a spark ignition engine. Exhaust gases may approach temperatures of 1,000 degrees Celsius. Ideally, the temperature of the EGR gas is reduced to approximately 150 degrees Celsius or below before being fed into the intake manifold or intake side of the engine. Conventional engines with an EGR system often use a water cooled heat exchanger to reduce the EGR gas temperature. These heat exchangers are sized based on the maximum flow rate and the maximum temperature reduction for the EGR gases.

SUMMARY

According to an embodiment, an engine is provided with a cylinder head defining an exhaust passage in the head fluidly coupling at least one exhaust runner and an exhaust port on a side of the head. An exhaust gas recirculation (EGR) passage is provided within the head and fluidly couples the exhaust passage to an EGR port on the side. The head also has a fluid passage. The EGR passage has a portion extending generally parallel with the side. The fluid passage is adjacent to and surrounds a majority of a perimeter of the portion of the EGR passage to at least partially cool EGR gases. An EGR cooler is in fluid communication with the EGR passage of the head and receives EGR gases therefrom. An intake manifold is in fluid communication with the EGR cooler and receives EGR gases therefrom. The intake manifold is fluidly coupled to the head.

According to another embodiment, an engine component is provided by a cylinder head defining first and second exhaust runners fluidly coupled to an exhaust passage extending transversely in the head to an exhaust port on an exhaust side. The head defines an exhaust gas recirculation (EGR) passage connected to the exhaust passage and extending longitudinally to an EGR port on the exhaust side. The head also defines a cooling jacket passage adjacent to and substantially surrounding the EGR passage to cool EGR gases.

According to yet another embodiment, an engine component is provided by a cylinder head defining an exhaust gas recirculation (EGR) passage fluidly coupling an exhaust passage within the head and an EGR port on a side of the head. A portion of the EGR passage is spaced apart from and extends alongside the side. The head defines a cooling passage wrapped substantially around the portion of the EGR passage for cooling the EGR gases flowing therethrough.

Various embodiments of the present disclosure have associated, non-limiting advantages. For example, a cylinder head of an engine may include a passage to divert EGR gases within the cylinder head and direct the EGR gases to an EGR port on the head. The EGR passage may be shaped such that the EGR gases travel a distance within the head. The EGR passage is substantially surrounded or wrapped by a fluid passage in the head to provide for cooling of the EGR gases within the head. The fluid passage may be formed by a cooling passage in a cooling jacket in the head according to an example. The EGR passage and/or the fluid passage may additionally be provided with additional surface features to enhance heat transfer from the EGR gases to the cooling fluid. For example, fins may be provided within the EGR passage and/or fluid passage, and any conduits connecting various components of the EGR system may additionally have surface features such as fins for cooling the EGR gases. The present disclosure provides for cooling of the EGR gases via heat transfer pathways beyond those provided by an EGR cooler, thereby allowing for the EGR cooler size and/or capacity to be reduced.

DETAILED DESCRIPTION

As required, detailed embodiments of the present disclosure are provided herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
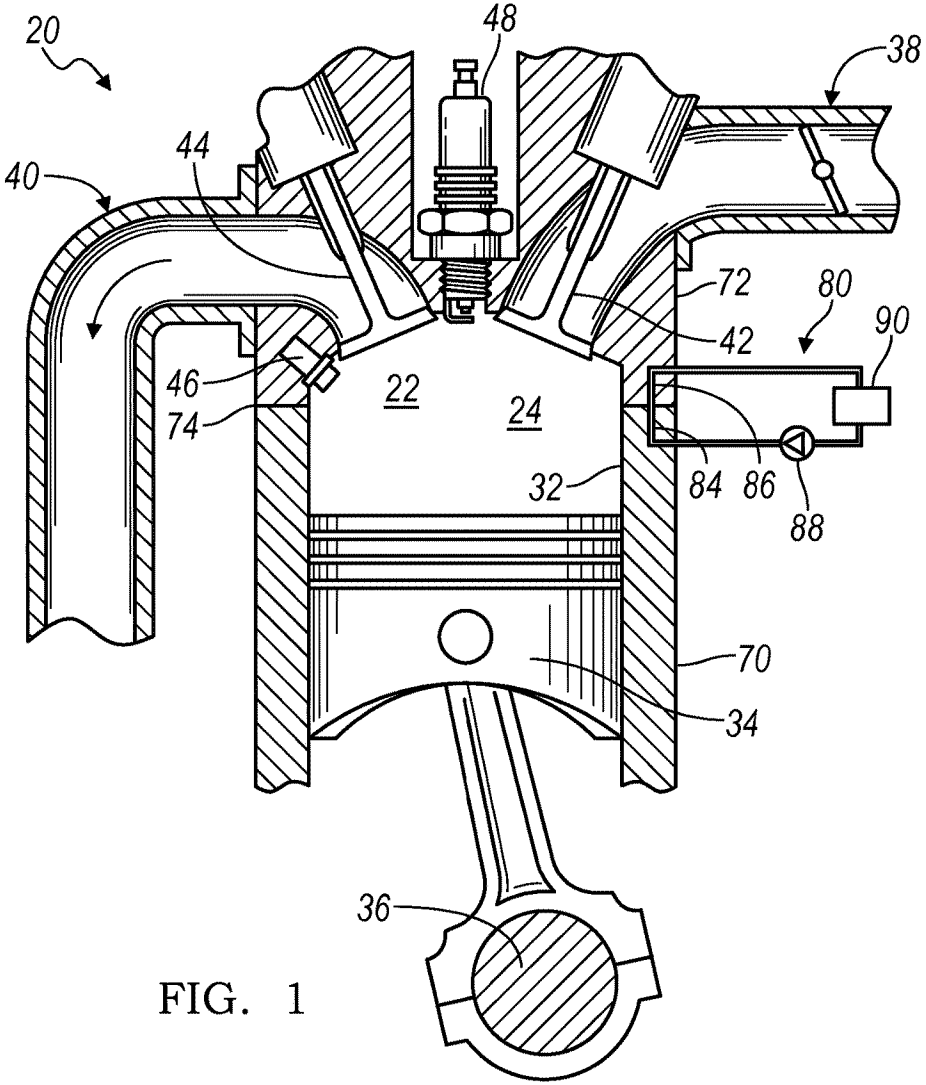
FIG. 1 illustrates an internal combustion engine capable of employing various embodiments of the present disclosure.

FIG. 1 illustrates a schematic of an internal combustion engine 20. The engine 20 has a plurality of cylinders 22, and one cylinder is illustrated. The engine 20 may have any number of cylinders, and the cylinders may be arranged in various configurations. The engine 20 has a combustion chamber 24 associated with each cylinder 22. The cylinder 22 is formed by cylinder walls 32 and piston 34. The piston 34 is connected to a crankshaft 36. The combustion chamber 24 is in fluid communication with the intake manifold 38 and the exhaust manifold 40. An intake valve 42 controls flow from the intake manifold 38 into the combustion chamber 24. An exhaust valve 44 controls flow from the combustion chamber 24 to the exhaust manifold 40. The intake and exhaust valves 42, 44 may be operated in various ways as is known in the art to control the engine operation.

A fuel injector 46 delivers fuel from a fuel system directly into the combustion chamber 24 such that the engine is a direct injection engine. A low pressure or high pressure fuel injection system may be used with the engine 20, or a port injection system may be used in other examples. An ignition system includes a spark plug 48 that is controlled to provide energy in the form of a spark to ignite a fuel air mixture in the combustion chamber 24. In other embodiments, other fuel delivery systems and ignition systems or techniques may be used, including compression ignition.

The engine 20 includes a controller and various sensors configured to provide signals to the controller for use in controlling the air and fuel delivery to the engine, the ignition timing, the power and torque output from the engine, the exhaust system, and the like. Engine sensors may include, but are not limited to, an oxygen sensor in the exhaust manifold 40, an engine coolant temperature sensor, an accelerator pedal position sensor, an engine manifold pressure (MAP) sensor, an engine position sensor for crankshaft position, an air mass sensor in the intake manifold 38, a throttle position sensor, an exhaust gas temperature sensor in the exhaust manifold 40, and the like.

In some embodiments, the engine 20 is used as the sole prime mover in a vehicle, such as a conventional vehicle, or a stop-start vehicle. In other embodiments, the engine may be used in a hybrid vehicle where an additional prime mover, such as an electric machine, is available to provide additional power to propel the vehicle.

Each cylinder 22 may operate under a four-stroke cycle including an intake stroke, a compression stroke, an ignition stroke, and an exhaust stroke. In other embodiments, the engine may operate with a two stroke cycle. During the intake stroke, the intake valve 42 opens and the exhaust valve 44 closes while the piston 34 moves from the top of the cylinder 22 to the bottom of the cylinder 22 to introduce air from the intake manifold to the combustion chamber. The piston 34 position at the top of the cylinder 22 is generally known as top dead center (TDC). The piston 34 position at the bottom of the cylinder is generally known as bottom dead center (BDC).

During the compression stroke, the intake and exhaust valves 42, 44 are closed. The piston 34 moves from the bottom towards the top of the cylinder 22 to compress the air within the combustion chamber 24.

Fuel is then introduced into the combustion chamber 24 and ignited. In the engine 20 shown, the fuel is injected into the chamber 24 and is then ignited using spark plug 48. In other examples, the fuel may be ignited using compression ignition.

During the expansion stroke, the ignited fuel air mixture in the combustion chamber 24 expands, thereby causing the piston 34 to move from the top of the cylinder 22 to the bottom of the cylinder 22. The movement of the piston 34 causes a corresponding movement in crankshaft 36 and provides for a mechanical torque output from the engine 20.

During the exhaust stroke, the intake valve 42 remains closed, and the exhaust valve 44 opens. The piston 34 moves from the bottom of the cylinder to the top of the cylinder 22 to remove the exhaust gases and combustion products from the combustion chamber 24 by reducing the volume of the chamber 24. The exhaust gases flow from the combustion cylinder 22 to the exhaust manifold 40 and to an after treatment system such as a catalytic converter.

The intake and exhaust valve 42, 44 positions and timing, as well as the fuel injection timing and ignition timing may be varied for the various engine strokes.

The engine 20 has a cylinder block 70 and a cylinder head 72 that cooperate with one another to form the combustion chambers 24. A head gasket (not shown) may be positioned between the block 70 and the head 72 to seal the chamber 24. The cylinder block 70 has a block deck face that corresponds with and mates with a head deck face of the cylinder head 72 along part line 74.

The engine 20 includes a fluid system 80. In one example, the fluid system is a cooling system to remove heat from the engine 20. In another example, the fluid system 80 is a lubrication system to lubricate engine components.

For a cooling system 80, the amount of heat removed from the engine 20 may be controlled by a cooling system controller or the engine controller. The system 80 may be integrated into the engine 20 as one or more cooling jackets. The system 80 has one or more cooling circuits that may contain water or another coolant as the working fluid. In one example, the cooling circuit has a first cooling jacket 84 in the cylinder block 70 and a second cooling jacket 86 in the cylinder head 72 with the jackets 84, 86 in fluid communication with each other. The block 70 and the head 72 may have additional cooling jackets. Coolant, such as water, in the cooling circuit 80 and jackets 84, 86 flows from an area of high pressure towards an area of lower pressure.

The fluid system 80 has one or more pumps 88. In a cooling system 80, the pump 88 provides fluid in the circuit to fluid passages in the cylinder block 70, and then to the head 72. The cooling system 80 may also include valves (not shown) to control the flow or pressure of coolant, or direct coolant within the system 80. The cooling passages in the cylinder block 70 may be adjacent to one or more of the combustion chambers 24 and cylinders 22. Similarly, the cooling passages in the cylinder head 72 may be adjacent to one or more of the combustion chambers 24 and cylinders 22, and the exhaust ports for the exhaust valves 44. Fluid flows from the cylinder head 72 and out of the engine 20 to a heat exchanger 90 such as a radiator where heat is transferred from the coolant to the environment.

Figure 2:
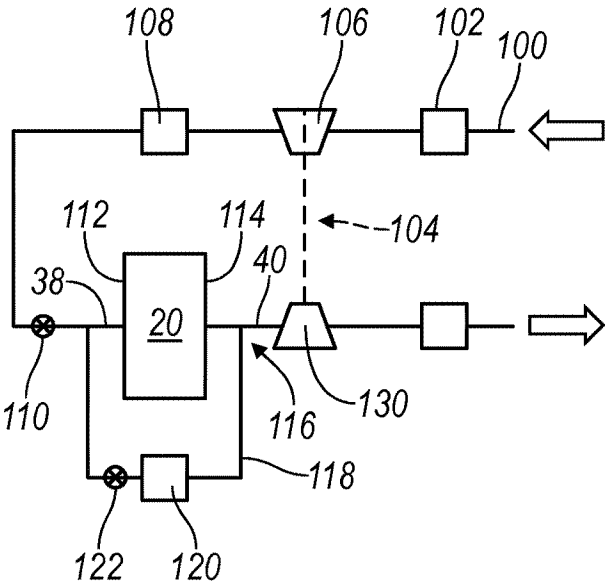
FIG. 2 illustrates a schematic of an exhaust system for the engine of FIG. 1.

FIG. 2 illustrates a schematic of an engine according to an example, and may use the engine 20 as described above with respect to FIG. 1. Intake air enters the intake 38 at inlet 100. The air is then directed through an air filter 102.

In some examples, the engine 20 may be provided with a turbocharger or a supercharger device to increase the pressure of the intake air, and thereby increase the mean effective pressure in the engine to increase the engine power output. The engine 20 is illustrated as having a turbocharger 104; however, other examples of the engine 20 have a supercharger, or are naturally aspirated. The turbocharger 104 may be any suitable turbomachinery device. The intake air is compressed by the compressor portion 106 of the turbocharger 104, and may then flow through an intercooler 108 or other heat exchanger to reduce the temperature of the intake air after the compression process.

The intake air flow is controlled by a throttle valve 110. The throttle valve 110 may be electronically controlled using an engine control unit, or may be otherwise activated or controlled. The intake air flows through an intake manifold on the intake side 112 of the engine 20. The intake air is then mixed and reacted with fuel to provide power from the engine 20.

The engine's exhaust gases flow through exhaust runners and to an exhaust manifold on the exhaust side of the engine 20. In the present example, the exhaust runners and at least a portion of the exhaust manifold may be incorporated into the engine cylinder head as integrated passages, for example, using a casting process.

A portion of the exhaust gases in the exhaust 40 may be diverted at 116 to enter an exhaust gas recirculation (EGR) loop 118 made up of the various components described herein that are connected directly to one another or connected using one or more connecting conduits. The EGR gases in the EGR loop 118 may be directed through an EGR cooler 120 or heat exchanger or heat exchanger to reduce the temperature of the EGR gases. The temperature of the exhaust gases at 116 may be as high as 1000 degrees Celsius.

In the engine 20, the EGR takeoff may be incorporated into the passages in the cylinder head of the engine 20. The EGR gases may be pre-cooled within the cylinder head of the engine 20 to reduce the load on the EGR cooler 120. By providing for cooling of the EGR gases prior to the heat exchanger 120, the size and/or capacity of the heat exchanger 120 may be reduced, providing a more compact and lighter component for the engine 20. Also by providing for pre-cooling of the EGR gases prior to the heat exchanger 120, better control over the temperature of the EGR gases at the engine intake 38 may be obtained.

The EGR gases in the heat exchanger may be cooled using a fluid in an existing engine system, for example, engine coolant, oil or lubricant, or the like. Alternatively, the EGR cooler may be cooled using environmental air. In further examples, the EGR cooler 120 is part of a stand-alone system within the vehicle and the EGR gases are cooled by a fluid within the system.

A valve 122 may be provided in the EGR system 118 to control the flow of the EGR gases to the intake 38. The valve 122 may be controlled using the engine control unit or another controller in the vehicle. The EGR gases in the loop 118 are mixed within the intake air in the intake 38 for the engine 20. The EGR gases may be cooled to a target temperature or a predetermined temperature for mixing with the intake air. In one example, the EGR gases are cooled to approximately 150 degrees Celsius, although other temperatures are contemplated.

The use of EGR in the engine 20 may provide for reduced emissions from the engine 20 by reducing the peak temperature during combustion, for example, EGR may reduce NOx. EGR may also increase the efficiency of the engine 20, thereby improving fuel economy. However, if the EGR gases are insufficiently cooled, pre-ignition may occur in the engine 20.

The remaining exhaust gases at 116 that are not diverted for EGR continue through the exhaust manifold 40. If the engine 20 has a turbocharger, the exhaust gases flow through the turbine portion 130 of the device 104. The device 104 may have a bypass or other control mechanism associated with the compressor 106 and/or the turbine 130 to provide for control over the inlet pressure, the back pressure on the engine, and the mean effective pressure for the engine 20. The exhaust gases are then directed through one or more aftertreatment devices 132. Examples of aftertreatment devices 132 include, but are not limited to, catalytic converters, particulate matter filters, mufflers.

Figure 3:
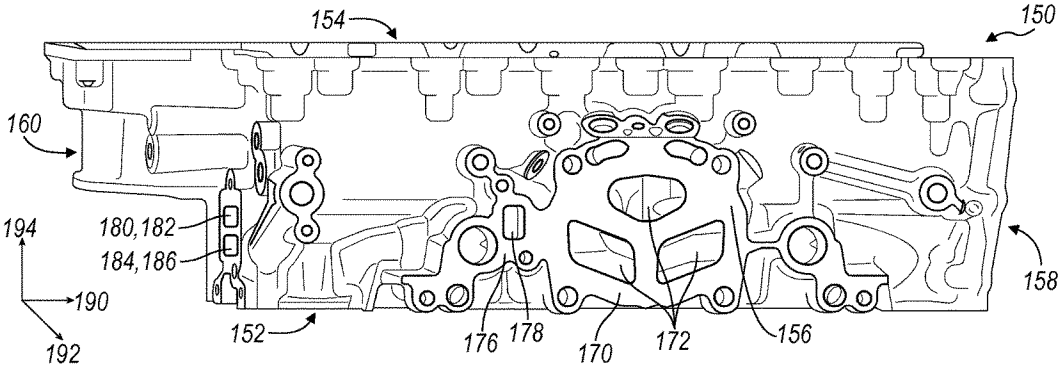
FIG. 3 illustrates a perspective view of a cylinder head according to an embodiment.

FIG. 3 illustrates an engine component such as a cylinder head 150. The cylinder head 150 may be used with the engine 20 as illustrated in FIGS. 1 and 2. The cylinder head 150 as illustrated is configured for use with an in-line, spark ignition, turbocharged, variable displacement engine. The cylinder head 150 may be reconfigured for use with other engines and remain within the spirit and scope of the disclosure. The cylinder head 150 may be formed from a number of materials, including iron and ferrous alloys, aluminum and aluminum alloys, other metal alloys, composite materials, and the like.

The cylinder head has a deck face 152 or deck side that corresponds with the part line 74 of FIG. 1 and that is configured to mate with a head gasket and the deck face of a corresponding cylinder block to form the engine block. Opposed from the deck face 152 is a top face, side, or surface 154. An exhaust face or side 156 of the cylinder head provides mounting features for an external exhaust manifold, and corresponds with element 114 in FIG. 2. An intake face or side (not shown) is opposed to the exhaust face 156, provides mounting features for the intake manifold of the engine, and corresponds with element 112. The cylinder head 150 also has first and second opposed ends 158, 160. Although the faces are shown as being generally perpendicular to one another, other orientations are possible, and the faces may be oriented differently relative to one another to form the head 150.

The exhaust side 156 of the head 150 has a mounting face 170 for an external exhaust manifold or other conduit to direct exhaust gases to a turbocharger, an aftertreatment device, or the like. The cylinder head 150 as shown has three exhaust ports 172, although any number of exhaust ports from the head 150 is contemplated.

The exhaust side 156 of the head 150 also has a mounting face 176 for an EGR cooler 120 or a conduit to direct EGR gases to the EGR cooler. The mounting face 176 defines an EGR port 178. The EGR gases are diverted from the exhaust gas stream within the head 150. The mounting faces 170, 176 are illustrated as being co-planar and continuous; however, the faces 170, 176 may be offset, spaced apart, angled relative to one another, or otherwise oriented on the head 150.

The cylinder head 150 has a fluid jacket formed within and integrated into the head 150, for example, during a casting or molding process. The fluid jacket may be a cooling jacket, as described herein, or may be a lubrication jacket in other examples.

In the head 150 as shown, there are two cooling jackets within the head 150. An inlet or outlet port 180 is illustrated for an upper cooling jacket 182. An inlet or an outlet port 184 is also illustrated for a lower cooling jacket 186. The cooling jackets 182, 186 may be in fluid communication with one another inside the head 150, or may be separate from one another. In other examples, the head 150 may only have a single cooling jacket, or may have more than two jackets.

The head 150 has a longitudinal axis 190 that may correspond with the longitudinal axis of the engine, a lateral or transverse axis 192, and a vertical or normal axis 194. The normal axis 194 may or may not be aligned with a gravitational force on the head 150.

Figure 4:
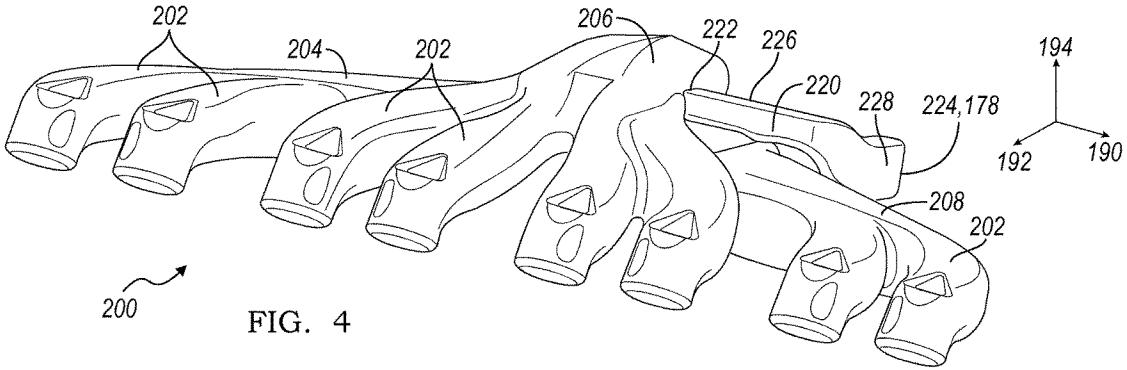
FIG. 4 illustrates a core for the exhaust passages within the cylinder head of FIG. 3.

FIG. 4 illustrates a core 200 for forming the exhaust passages within the head 150. The core 200 represents a negative view of the passages within the head 150. Exhaust runners 202 are provided, with two exhaust runners for each cylinder. The exhaust runners may include seats for exhaust valves 44 on an end region of each runner 202.

The core 200 also has three exhaust passages 204, 206, 208. As can be seen in the Figure, exhaust gases from one or multiple cylinders may be directed to exhaust passages by the runners. Each exhaust passage provides a fluid connection between the runners and a respective exhaust port. For example, exhaust passage 204 fluidly connects cylinder I of an engine to the lower right port 172 in FIG. 3, exhaust passage 208 fluidly connects cylinder IV of the engine to the lower left port 172 in FIG. 3, and exhaust passage 206 fluidly connects cylinders II and III of the engine to the upper central port 172 in FIG. 3.

The exhaust runners and the exhaust passages may extend generally transversely in the head 150 to the exhaust side of the engine, with the transverse axis 192 shown for reference.

An EGR passage 220 is provided within the cylinder head 150 and is fluidly connected or coupled to an exhaust passage, such as passage 206 at one end 222. The other end 224 of the EGR passage 220 provides the EGR port 178 on the side of the head 150. The EGR passage 220 directs or diverts a portion of the exhaust gases within the exhaust passage 206 to the EGR port 178.

In one example, the EGR passage 220 has a first portion 226 that extends generally longitudinally in the cylinder head 150. The first portion 226 may extend alongside or extend generally parallel with the side 156 of the head 150. The first portion 226 is spaced apart from the side 156 such that it is internal to the head 150. The first portion 226 may be directly fluidly coupled to the exhaust passage 206 such that the end 222 is included in the first portion 226.

The EGR passage 220 may also have a second portion 228 that is positioned at an angle relative to the first portion 226. The second portion 228 may provide a fluid connection or flow path between the first portion 226 and the EGR port 178. The second portion 228 may extend generally transversely in the head, and generally transversely relative to the first portion 226.

In other examples, the EGR passage 220 may have other sections, portions, or shapes, and the various portions may be positioned in other configurations relative to the head 150 and each other.

Figure 5:
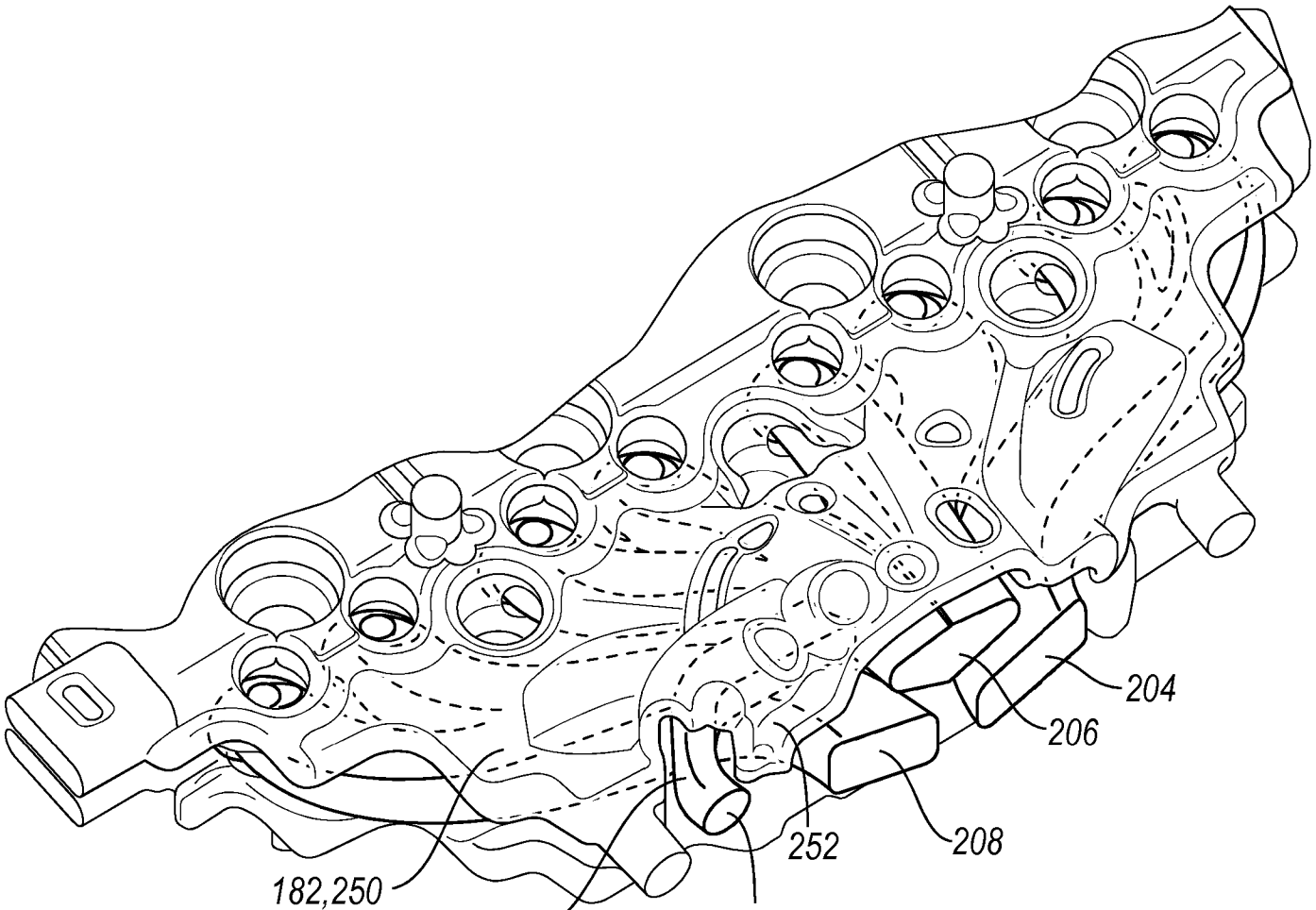
FIG. 5 illustrates a core for a water jacket and the core of FIG. 4 for the cylinder head of FIG. 3.
Figure 6:
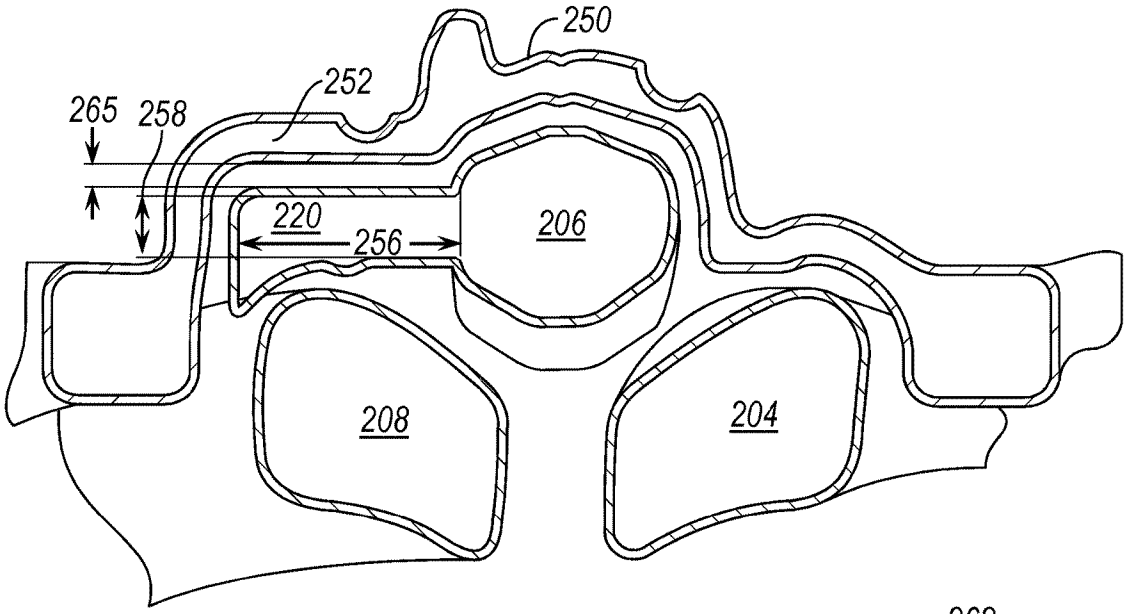
FIG. 6 illustrates a sectional view of the cylinder head of FIG. 3 according to an embodiment.
Figure 7:
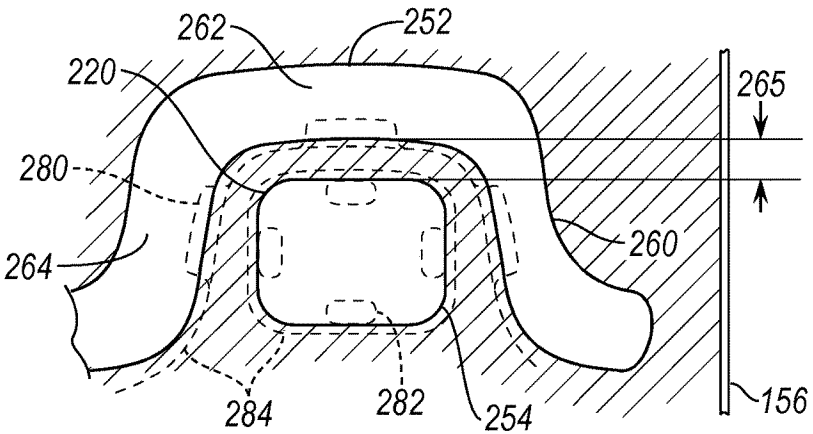
FIG. 7 illustrates a sectional view of the cylinder head of FIG. 3 according to an embodiment.

FIGS. 5-7 illustrate the core 200 for the exhaust passages with a core 250 for the upper cooling jacket 182. The core 250 represents a negative view of the cooling passages for the upper cooling jacket 182 within the head 150.

The core 250 provides for a fluid passage 252 or a cooling passage adjacent to and surrounding a majority of a perimeter 254 of the EGR passage 220 to at least partially cool EGR gases before they exit the cylinder head 150. The perimeter 254 of the EGR passage 220 may be in the first portion and/or the second portion of the passage 220. The passage 252 is adjacent to and surrounds the majority of the perimeter 254 of the EGR passage 220 for a length 256 of the portion. In one example, the length 256 is greater than an effective diameter 258 of the passage 220.

The passage 252 substantially surrounds the EGR passage 220 such that the cooling passage 252 is wrapped substantially around the EGR passage 220 to cool the EGR gases flowing therethrough.

The passage 252 substantially surrounds a perimeter 254 and/or surrounds a majority of the perimeter 254 by surrounding greater than 50% of the perimeter 254 in one example. In another example passage 252 substantially surrounds a perimeter 254 and/or surrounds a majority of the perimeter 254 by surrounding at least 75 percent of the EGR passage 220. In a further example, the passage 252 substantially surrounds a perimeter 254 and/or surrounds a majority of the perimeter 254 by surrounding 50.1-95% of the perimeter 254, surrounding 50.1-75%, surrounds 75-95%, or surrounding greater than 95% of the perimeter 254.

As can be seen in FIGS. 5 and 6, the fluid passage 252 and the cooling jacket 182 may also be adjacent to the runners and the exhaust passages in the head. For example, the passage 252 may be adjacent to the runners 202 providing exhaust gases to exhaust passage 206.

The cooling passage 252 may have a u-shaped cross section, and this u-shaped cross section may extend along the length 256 of the passage 220. In one example, the cooling passage 252 has a region 260 providing for fluid flow between the EGR passage 220 and the exhaust side or face 156. The cooling passage 252 has a region 262 providing for fluid flow between the EGR passage 220 and the top side or face 154. The cooling passage 252 has a region 264 providing for fluid flow between the EGR passage 220 and the exhaust side or exhaust mount face.

The cooling passage 252 is adjacent to and separated from the EGR passage 220 by a thin wall 265 that is formed by the cylinder head 150.

The cooling passage 252 may include a cap region 266 that wraps around the EGR passage 220 and wraps to substantially cover the second portion 228. The cap region 266 may provide for fluid flow between the EGR passage 220 and the end face 160.

As the engine operates, exhaust gases flow from the cylinders into the runners 202 and into exhaust passage 206. A portion of the exhaust gases may be diverted into the EGR passage 220. A fluid, such as engine coolant, circulates in the cooling jacket 186 and through fluid passage 252. The temperature of the EGR gases may be as high as 1000 degrees Celsius at the entrance to the EGR passage 220, e.g. at end 222. Heat is transferred from the EGR gases in the passage 220 through the material of the cylinder head 150, and to the fluid in the cooling passage 252. The heat may be primarily transferred via conduction and convection. The temperature of the EGR gases may be reduced at the exit of the EGR passage, e.g. at end 224 or the EGR port 178. An EGR cooler positioned downstream of the cylinder head in the EGR loop provides any additional cooling of the EGR gases such that they are in a selected range to be mixed with intake air in the inlet manifold of the engine.

In some examples, additional features may be provided in the cooling passage 252 and/or the EGR passage 220 to enhance heat transfer from the EGR gases to the fluid in the passage 252. Examples of these features are illustrated in broken lines in FIG. 7.

The cooling passage 252 may include a series of surface features 280 adjacent to the EGR passage 220 to increase the surface area of the passage 252, thereby increasing heat transfer. The surface features 280 are illustrated as a series of fins. In other examples, the surface features 280 may be other shapes, or other protrusions, depressions, or other contours may be provided. The surface features 280 may be provided as a part of the cooling core 250 such that the features are formed within the head 150 when it is cast, molded, or otherwise formed.

The EGR passage 220 may include a series of surface features 282 that are adjacent to the cooling passage 252 to increase the surface area of the EGR passage 220, thereby increasing heat transfer. The surface features 282 may be provided around at least a portion of the perimeter 254. The surface features 282 are illustrated as a series of fins. In other examples, the surface features 282 may be other shapes, or other protrusions, depressions, or other contours may be provided. The surface features 282 may be provided as a part of the core 200 such that the features are formed within the head 150 when it is cast, molded, or otherwise formed. The surface feature or fin design may be based on limitations introduced by making the core.

In further examples, one or more layers 284 may be provided within the head 150 to enhance heat transfer. The layers 284 may be formed from a material with a higher thermal conductivity to provide for enhanced heat transfer between the EGR gases in the EGR passage 220 and the fluid in the cooling passage 252. In one example, the cylinder head 150 is formed from a composite material and the layers 284 are formed from a metal such as aluminum or copper.

The EGR passage 220 is illustrated as being fluidly connected to the exhaust passage 206. In the example shown, the cylinder head 150 may be used with an engine operated as a variable displacement engine, where cylinders may be selectively deactivated during engine operation to increase fuel economy. In two central cylinders in the engine providing exhaust gases to exhaust passage 206 are continuously operated in the present example, and the EGR passage 220 is therefore connected to exhaust passage 206 as it will always provide exhaust gases when the engine is operating, as these cylinders are always active.

Various embodiments of the present disclosure have associated, non-limiting advantages. For example, a cylinder head of an engine may include a passage to divert EGR gases within the cylinder head and direct the EGR gases to an EGR port on the head. The EGR passage may be shaped such that the EGR gases travel a distance within the head. The EGR passage is substantially surrounded or wrapped by a fluid passage in the head to provide for cooling of the EGR gases within the head. The fluid passage may be formed by a cooling passage in a cooling jacket in the head according to an example. The EGR passage and/or the fluid passage may additionally be provided with additional surface features to enhance heat transfer from the EGR gases to the cooling fluid. For example, fins may be provided within the EGR passage and/or fluid passage, and any conduits connecting various components of the EGR system may additionally have surface features such as fins for cooling the EGR gases. The present disclosure provides for cooling of the EGR gases via heat transfer pathways beyond those provided by an EGR cooler, thereby allowing for the EGR cooler size and/or capacity to be reduced.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An engine comprising:

a cylinder head defining an exhaust passage in the head fluidly coupling at least one exhaust runner and an exhaust port on a side of the head, an exhaust gas recirculation (EGR) passage within the head and fluidly coupling the exhaust passage to an EGR port on the side, and a fluid passage, the EGR passage having a portion extending generally parallel with the side, the fluid passage adjacent to and surrounding a majority of a perimeter of the portion of the EGR passage to at least partially cool EGR gases;

an EGR cooler in fluid communication with the EGR passage of the head and receiving EGR gases therefrom; and an intake manifold in fluid communication with the EGR cooler and receiving EGR gases therefrom, the intake manifold fluidly coupled to the head.

2. The engine of claim 1 wherein the fluid passage is adjacent to and surrounds the majority of the perimeter of the portion of the EGR passage for a length of the portion, the length being greater than a diameter of the portion of the passage.

3. The engine of claim 2 wherein the fluid passage is u-shaped along the length of the portion.

4. The engine of claim 1 wherein the head further defines a cooling jacket including the fluid passage; and wherein the engine further comprises a cooling system in fluid communication with the fluid passage.

5. The engine of claim 1 wherein the head further defines a lubrication jacket including the fluid passage; and wherein the engine further comprises a lubrication system in fluid communication with the fluid passage.

6. The engine of claim 1 further comprising a connecting conduit configured to fluidly connect the EGR cooler to one of the EGR port and the intake manifold, the connecting conduit comprising a series of external fins to increase heat transfer from the EGR gases to a surrounding environment.

7. The engine of claim 1 wherein at least one of the EGR passage and the fluid passage has a series of heat transfer surface features.

8. A cylinder head comprising:

a body defining first and second exhaust runners fluidly coupled to an exhaust passage extending transversely in the head to an exhaust port on an exhaust side, an exhaust gas recirculation (EGR) passage connected to the exhaust passage and extending longitudinally to an EGR port on the exhaust side, and a cooling jacket passage adjacent to and substantially surrounding the EGR passage to cool EGR gases.

9. The cylinder head of claim 8 wherein the exhaust passage is a first exhaust passage, and the exhaust port is a first exhaust port; and wherein the body defines a third exhaust runner fluidly coupled to a second exhaust passage extending transversely in the head to a second exhaust port on the exhaust side, the second exhaust port adjacent to the first exhaust port.

10. The cylinder head of claim 9 wherein the body defines a fourth exhaust runner fluidly coupled to a third exhaust passage extending transversely in the head to a third exhaust port on the exhaust side, the third exhaust port adjacent to the first and second exhaust ports.

11. The cylinder head of claim 10 wherein the first and second runners are positioned between the third runner and the fourth runner.

12. The cylinder head of claim 8 wherein the body has a lower cooling jacket, and an upper cooling jacket providing the cooling jacket passage.

13. The cylinder head of claim 8 wherein the cooling jacket passage is also adjacent to the first and second exhaust runners.

14. An engine component comprising:

a cylinder head defining an exhaust gas recirculation (EGR) passage fluidly coupling an exhaust passage within the head and an EGR port on a side of the head, a portion of the EGR passage spaced apart from and extending alongside the side, the head defining a cooling passage wrapped substantially around the portion of the EGR passage for cooling the EGR gases flowing therethrough.

15. The engine component of claim 14 wherein at least seventy five percent of a perimeter of the portion of the EGR passage is wrapped by the cooling passage.

16. The engine component of claim 14 wherein the portion of the EGR passage is a first portion extending longitudinally in the cylinder head from the exhaust passage, the EGR passage having a second portion extending at an angle from the first portion to the EGR port.

17. The engine component of claim 16 wherein the second portion extends transversely from the first portion to the EGR port.

18. The engine component of claim 16 wherein the cylinder head has a deck face configured to mate with an engine block, an intake face, an exhaust face with the EGR port, and a top face opposed to the deck; and wherein the cooling passage wraps about the first portion of the EGR passage along a length of the first portion and is positioned between the EGR passage and the intake face, the exhaust face, and the top face.

19. The engine component of claim 18 wherein the cylinder head has a first end face and a second opposed end face, wherein the EGR passage is positioned between the exhaust passage and the first end face; and wherein the cooling passage wraps about the second portion of the EGR passage and is positioned between the EGR passage and the first end face.

20. The engine component of claim 14 wherein at least one of the EGR passage and the cooling passage include a series of heat transfer fins.

* * * * *